US005676232A

United States Patent [19]

McGough

[11] Patent Number: 5,676,232

[45] Date of Patent: Oct. 14, 1997

[54] COIN CHUTE TRIGGER ASSEMBLY FOR PAY TELEPHONES WITH MICROSWITCHES

[75] Inventor: Gerald B. McGough, Huntsville, Ala.

[73] Assignee: Quadrum Telecommunications, Inc., Huntsville, Ala.

[21] Appl. No.: 635,416

[22] Filed: Apr. 26, 1996

[51] Int. Cl.[6] ..... H01H 3/42

[52] U.S. Cl. ..... 194/244; 200/286; 200/DIG. 3

[58] Field of Search ..... 194/219–223, 194/230, 239, 242, 244; 200/DIG. 3, 286

[56] References Cited

U.S. PATENT DOCUMENTS

| | | | |
|---|---|---|---|
| 1,760,462 | 5/1930 | Yeo | 194/219 X |
| 2,674,655 | 4/1954 | Gallagher . | |
| 2,687,793 | 8/1954 | Gallagher et al. . | |
| 2,881,254 | 4/1959 | Gallagher . | |
| 3,423,533 | 1/1969 | LaBarge . | |
| 3,596,017 | 7/1971 | Williams | 200/286 X |
| 3,696,905 | 10/1972 | Tojza et al. | 194/221 |
| 3,980,852 | 9/1976 | Redfield | 200/574 |
| 4,747,134 | 5/1988 | Holland et al. . | |
| 4,955,052 | 9/1990 | Hussain . | |

FOREIGN PATENT DOCUMENTS

| | | | |
|---|---|---|---|
| 951990 | 7/1974 | Canada | 194/244 |

*Primary Examiner*—F. J. Bartuska
*Attorney, Agent, or Firm*—Robert J. Black

[57] ABSTRACT

A coin chute trigger assembly having separate coin paths for nickels, dimes, and quarters. A microswitch is positioned adjacent to each coin path. A trigger included in each coin path is operated in response to deposit of the appropriate coin through the coin chute to cause operation of the included or adjacent microswitch.

7 Claims, 1 Drawing Sheet

COIN CHUTE TRIGGER ASSEMBLY FOR PAY TELEPHONES WITH MICROSWITCHES

BACKGROUND OF THE INVENTION

1. Field of the Invention

The present invention relates to pay or coin telephones and more particularly to a coin chute trigger assembly which utilizes microswitches as an effective replacement for leaf spring contacts as utilized in most existing coin chute designs.

2. Background Art

A search of the background art directed to the subject matter of the present application disclosed the following U.S. patents:

| U.S. Pat. No. | INVENTOR | ISSUE DATE |
|---|---|---|
| 2,674,655 | Gallagher | April 6, 1954 |
| 2,687,793 | Gallagher et al | August 31, 1954 |
| 2,881,254 | Gallagher et al | April 7, 1959 |
| 3,423,533 | LaBarge | January 21, 1969 |
| 4,747,134 | Holland et al | May 24, 1988 |
| 4,955,052 | Hussain | September 4, 1990 |

Based on a thorough review of the above-identified patents, it is believed none of the above teach, disclose, or claim the novel combination of elements and functions found in the improved product taught by the present invention.

The three patents to Gallagher and Gallagher et al were utilized in old-fashioned coin telephones which used three separate coin slots, i.e., one for nickels, one for dimes, and another for quarters. These patents utilized microswitches with wire fingers extending into the coin paths in connection with the old style hopper coin relays utilized with three-slot pay telephones. The included microswitches were utilized for signaling and/or controlling and restricting the use of the paystation. The microswitches were not operated by cams as taught in the present application, but were rather wire fingers actuated by coins.

LaBarge was an early single-slot coin telephone which utilized like the previous Gallagher patents a wire finger or lever actuators for the microswitches which were directly coin operated.

Holland et al teaches a hookswitch application utilizing cam actuated microswitches. This patent appears to be directed to sequencing of multiple contacts.

Hussain suggests the use of microswitches for coin signaling but fails to point out any detail as to configuration of the microswitches and their utilization.

Many different types of coin trigger devices have been employed for use in pay telephones or in other coin collecting machines. Such coin trigger devices employ various methods of identifying and counting coins. Existing mechanical coin chute trigger switches manufactured by Quadrum and others have been in their present configuration for almost twenty years. In such arrangements, essentially coins pass through a mechanism in three coin paths or rectangular tubes or coin chutes, one each for nickels, dimes, and quarters. As each coin traverses its path, it strikes and rotates a finger extension of a rotating switch actuator referred to as a trigger. Included on each trigger opposite the finger extension is a cam. This trigger cam, when rotated, operates an associated set of electrical contacts whereby in response to the switch contacts closure, separate electrical signals are generated for each type of coin deposited.

Each trigger assembly also includes a second finger which extends roughly 180° from the first and is utilized to strike a paddle or operating point of an associated coin relay mechanism which is not part of the present invention. This action occurs when an initial coin deposit is made. The paddle, in conjunction with a cam and switch, imparts a first coin signal and generates important data for use in processing a call.

It is noted that the present invention is suitable for use in pay telephones similar to those in current use and particularly for use in pay telephones as manufactured by Quadrum Telecommunications. In such units in response to deposit of coins signals are transmitted to an associated telephone central office. Such signals may be utilized for establishing and energizing circuits for an associated coin relay. At the telephone central office, application of voltage of one polarity will cause coins to be collected, while application of voltage of an opposite polarity will cause coins to be returned via a refund chute if such refund is appropriate. Operation of the relay also serves to restore the coin trigger circuitry to normal.

SUMMARY OF THE INVENTION

The present invention consists of a new coin chute trigger assembly equipped with microswitches to provide the necessary electrical switching function instead of leaf springs. By utilization of microswitches, the contacts are thus protected from physical damage and from environmental corrosion.

A particular unique aspect of the present invention in addition to the utilization of microswitches relates to the method by which the microswitches are mounted to the coin chute and their included actuator arm positions adjusted relative to the trigger cams on the associated triggers which are coin operated when the coin passes through the coin chutes included in the trigger assembly. The particular technique involves the utilization of dual brackets to provide mounting and positioning of the microswitches. As can be described, there are three microswitches provided, one for each coin, i.e., nickel, dime and quarter, which are mounted in parallel utilizing an inverted U-shaped bracket. Two long mounting screws pass through one leg of the bracket and through each of the three microswitches and screw into the opposite leg of the bracket to provide positioning of the three microswitches in side-by-side parallel arrangement. In this arrangement, the actuator arms of the microswitches extend downward and rest in a position on the trigger cams with one actuator arm of each switch resting on the cam that is part of the associated trigger. Included in the U-shaped bracket are upward facing notches on each of the U-shaped bracket vertical legs to accept the tip of a screwdriver or similar tool for positioning. There also are included two tapped holes in the middle top portion of the inverted U-shaped bracket for accepting screws for attachment to a second bracket. The second bracket is an L-shaped bracket that has a long horizontal leg parallel to and in contact with the middle or top portion of the inverted U-shaped bracket. A short leg is extended vertically downward being utilized for screw mounting to the associated coin chute assembly.

The long horizontal leg of the upper L-shaped bracket includes two pairs of holes or openings all of which are used in the adjustment process. The first openings are slots through which two mounting screws pass to mount the associated inverted U-shaped bracket. These holes are elongated to facilitate adjustment in a direction forward or away from the coin chute assembly. Screws are partially tightened initially from the L-shaped bracket into the lower or inverted U-shaped bracket.

At this point, the second set of openings in the upper or L-shaped bracket include a pair of slots which align with the notches in the legs of the inverted U-shaped bracket. A screwdriver is then inserted through each of these upper openings and into the respective notches in the inverted U-shaped bracket. The screwdriver is then utilized to pry the inverted U-shaped bracket into position in a forward direction towards the coin chute assembly, or away in order to have proper positioning of the microswitch actuator arms against the cams of the associated triggers. When proper contact and adjustment is secured, the upper mounting screws then are tightened, securing the U-shaped microswitch supporting bracket to the upper or L-shaped bracket ensuring a proper operating relationship between the triggers included in the coin chute trigger assembly each with its associated microswitch actuator.

From the foregoing it can be seen that when a coin is deposited through any of the included chutes in the coin chute trigger assembly, the trigger will be actuated and the cam will then move in a forward direction to operate against the microswitch actuator causing operation of the microswitch which in turn has its output connected to associated circuitry to provide a proper signaling to the telephone central office or other utilization circuitry.

BRIEF DESCRIPTION OF THE DRAWINGS

A better understanding of the present invention may be had from consideration of the following detailed description taken in conjunction with the following drawings.

DESCRIPTION OF THE PREFERRED EMBODIMENTS

Figure 1:
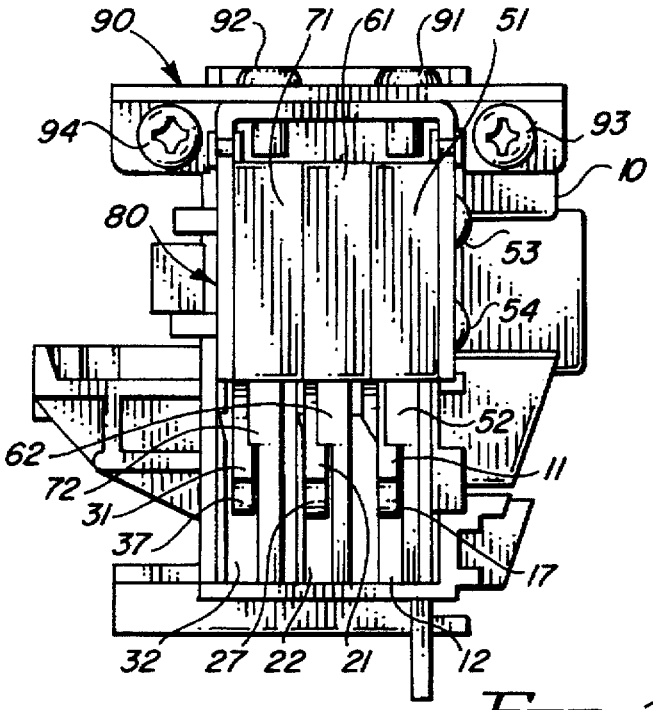
FIG. 1 is a front view of a coin chute trigger assembly in accordance with the present invention.
Figure 2:
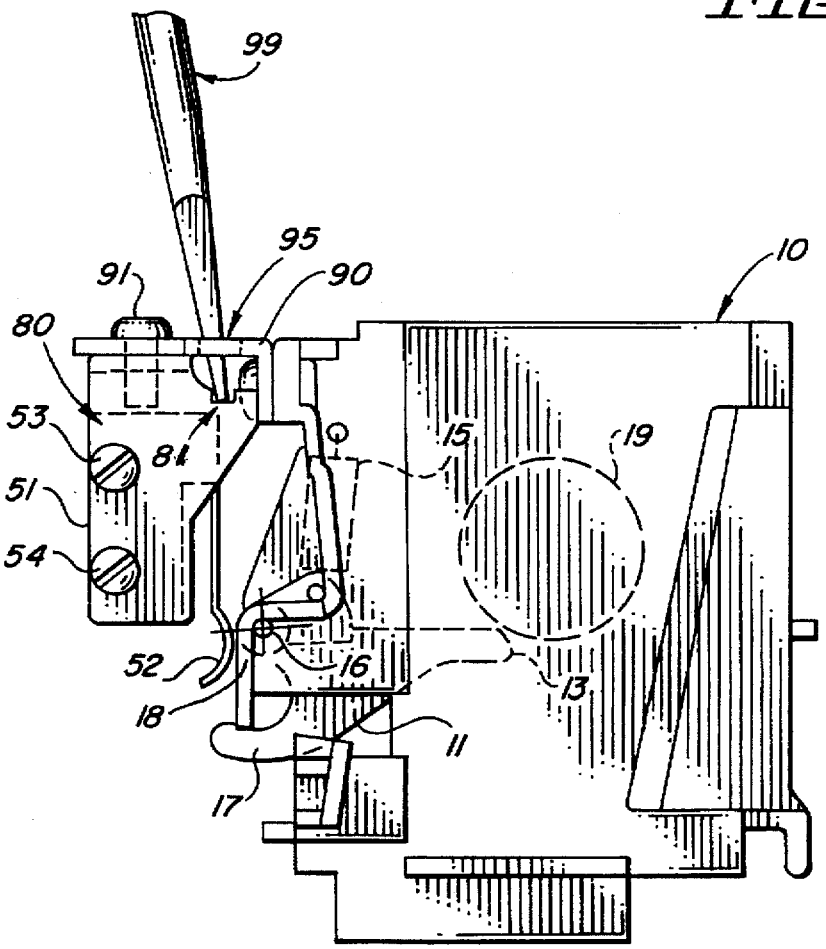
FIG. 2 is a right side view of a coin chute trigger assembly in accordance with the present invention.

Referring now to FIGS. 1 and 2 of the accompanying drawings in which similar numbers refer to the same part in the various views shown.

The present invention employs a one-piece coin chute trigger assembly 10 of unitary construction of clear transparent plastic. Included in the assembly are three parallel chutes numbered 12, 22, and 32, respectively. Chute 12 is intended to receive nickels, chute 22 dimes, and chute 32 quarters. As can be seen in FIG. 2, the chutes are tapered from top to bottom, being wider at the top portion and narrower at the bottom. Positioned adjacent to and protruding into each chute is a spring loaded rotating trigger, such as 11, 21, and 31, associated with chutes 12, 22, and 32, respectively. Each of these triggers rotates about an axle or pin 16 as may be seen in FIG. 2. Each trigger includes a first finger, such as 13, which includes an angled tip to prevent it being trapped in transition area that rotates about pin 16. Each trigger also includes a cam, such as 18, and a second finger, such as 17. Second fingers on the additional triggers are 27 and 37, respectively. As can be seen in FIG. 2, at the bottom of each coin path or chute, the opening of the chute is extended in a forward direction so as to function as a trigger guide for the associated trigger.

Attached to the coin chute trigger assembly are three microswitches 51, 61, and 71, each associated with an actuator, such as 52, 62, and 72, respectively. When a coin, such as 19, shown in phantom in FIG. 2, is passed through the chute, and the associated trigger is rotated as may be seen in FIG. 2, trigger 11 rotates about pin 16, and cam 18 engages actuator arm 52 of microswitch 51. Similarly, coins deposited through chutes 22 and 32 will cause second fingers 27 and 37, respectively, of triggers 21 and 31 to rotate about pin 16 and have the associated cam then engage the actuators of microswitches 61 and 71, respectively. When the above-identified microswitches are operated, a circuit connection for signals is transmitted to the telephone central office via circuitry not shown.

It should be noted that the second finger extensions of each trigger, such as 17, 27, and 37, extending from each trigger at approximately 180° from the first finger, are utilized to strike the paddle of an associated coin relay mechanism (not shown) whereby in conjunction with the cam and switch operation a first coin signal is transmitted to the telephone central office to be utilized in processing the call.

From the foregoing it may be seen that proper positioning and alignment of the microswitch actuators, such as 52, with a cam, such as 18, on the associated coin chute trigger, such as 11, is most important. Proper positioning is achieved by virtue of the mounting means and techniques employed for the microswitches. Initially, the three microswitches are placed in parallel relationship into an inverted U-shaped bracket 80. Two screws, such as 53 and 54, are then passed through one side of the one leg of the inverted U-shaped bracket 80, screwing into the distant leg. The top of the U-shaped bracket 80 is tapped to receive mounting screws, such as 91 and 92. Also included in each vertical leg are upward facing notches, such as 81 (and 82 not shown). These notches accept the tip of a screwdriver 99 or similar instrument for use in positioning during assembly.

The second bracket utilized in mounting the microswitches is L-shaped bracket 90 which has a short vertical leg extending in the downward direction utilized for mounting to coin chute 10 by means of screws, such as 93 and 94. The long leg, or horizontal leg, of bracket 90 includes two pairs of elongated holes or openings which are utilized in the adjustment process. It is through these holes that screws, such as 91 and 92, are inserted and then initially secured to inverted U-shaped bracket 80. The horizontal leg also includes slots, such as 95 and 96 (not shown), which align respectively with notches, such as 81 and 82, respectively.

During initial positioning, a screwdriver 99, or similar instrument, is inserted into each of the above-identified openings 95 and 96 and on into the respective notches 81 and 82 of bracket 80. By moving the screwdriver 99, bracket 80 can be moved in a forward or backward position relative to the coin chute assembly ensuring proper contact between the microswitch actuator arms, such as 52, 62, and 72, with cams, such as 18, 28, and 38 (which are not shown), to ensure proper operation when the associated triggers are operated causing the cams to operate against the microswitch actuators. At this point, screws 91 and 92 are secured tightly ensuring that the proper relationship is maintained between the coin chute trigger assembly triggers and the microswitch actuators.

While but a single embodiment of the present invention has been shown, it will be obvious to those skilled in the art that numerous modifications may be made without departing from the spirit of the present invention, which shall be limited only by the scope of the claims appended hereto.

What is claimed is:

1. For use in a coin telephone, a coin chute trigger assembly comprising:

a coin chute assembly including a plurality of coin paths each adapted to pass a coin of a different dimension;

a plurality of triggers each positioned adjacent to a different one of said coin paths, and each including a first portion projecting into the adjacent coin path;

each of said triggers further including a cam;

each trigger operated in response to passage of a coin through the adjacent coin path;

a plurality of microswitches mounted on said coin chute assembly each including an actuator positioned adjacent to a different one of said trigger cams;

said trigger further operated in response to passage of a coin through one of said coin paths to cause said included cam to operate said adjacent actuator whereby said microswitch which includes said operated actuator is rendered operated;

said coin chute trigger assembly further including adjustable mounting means secured to said coin chute assembly positioning a different one of said microswitches adjacent to each of said plurality of coin paths;

said mounting means including a first bracket including a vertical section secured to said coin chute assembly and an inverted U-shaped bracket supporting said plurality of microswitches.

2. A coin chute trigger assembly as claimed in claim 1 wherein:

there is further included a microswitch adjacent to each of said coin paths operated in response to operation of said adjacent trigger to cause said cam to operate said actuator arm of said adjacent microswitch, to render said microswitch operated.

3. A coin chute trigger assembly as claimed in claim 1 wherein:

each of said triggers further include a second portion adapted in response to operation of said trigger to operate an associated coin relay.

4. A coin chute trigger assembly as claimed in claim 1 wherein:

said first bracket further includes a horizontal section;

and said inverted U-shaped bracket supporting said microswitches is secured to said inverted U-shaped bracket.

5. A coin chute trigger assembly as claimed in claim 1 wherein:

said inverted U-shaped bracket further includes at least one tool-receiving notch.

6. A coin chute trigger assembly as claimed in claim 5 wherein:

said horizontal portion of said first bracket includes at least one tool-receiving opening adapted to facilitate the placement of a tool through said first bracket into said tool-receiving notch of said inverted U-shaped bracket, said U-shaped bracket in response to engagement by a tool in said tool-receiving notch, positioned for optimum contact between an adjacent cam and an included actuator of said microswitch.

7. For use in a coin telephone, a coin chute trigger assembly comprising:

a coin chute assembly including a first coin path adapted to pass nickels;

a second coin path adapted to pass dimes;

a third coin path adapted to pass quarters;

first, second, and third rotating triggers, each positioned adjacent to a different one of said coin paths and each including a cam, and a first finger extending into the adjacent coin path operated in response to a coin passing through said adjacent coin path to rotate said trigger;

first, second, and third microswitches each located adjacent to a different one of said coin paths;

each of said microswitches including an actuator positioned adjacent to the cam of a different one of said rotating triggers adjacent to different ones of said coin paths;

said cam in response to rotation of said trigger effective to operate said adjacent cam to render said adjacent microswitch operated;

said coin chute trigger assembly further including adjustable mounting means secured to aid coin chute assembly positioning a different one of said microswitches adjacent to each of said coin paths;

said mounting means including a first bracket including a vertical section secured to said coin chute assembly and an inverted U-shaped bracket supporting said plurality of microswitches.

* * * * *